US008434790B2

(12) United States Patent
Lenhart

(10) Patent No.: US 8,434,790 B2
(45) Date of Patent: May 7, 2013

(54) SKI-POLE BASKET

(75) Inventor: Klaus Lenhart, Ohmden (DE)

(73) Assignee: Lekisport AG, Baar (CH)

( * ) Notice: Subject to any disclaimer, the term of this patent is extended or adjusted under 35 U.S.C. 154(b) by 517 days.

(21) Appl. No.: 12/445,790

(22) PCT Filed: Nov. 13, 2007

(86) PCT No.: PCT/CH2007/000569
§ 371 (c)(1),
(2), (4) Date: Oct. 7, 2010

(87) PCT Pub. No.: WO2008/058416
PCT Pub. Date: May 22, 2008

(65) Prior Publication Data

US 2011/0018250 A1 Jan. 27, 2011

(30) Foreign Application Priority Data

Nov. 14, 2006 (CH) ..... 1829/06

(51) Int. Cl.
*A63C 11/24* (2006.01)

(52) U.S. Cl.
USPC ..... 280/824

(58) Field of Classification Search ..... 280/819, 280/824
See application file for complete search history.

(56) References Cited

U.S. PATENT DOCUMENTS

| | | | | | |
|---|---|---|---|---|---|
| 2,450,063 | A * | 9/1948 | Werner | 280/824 |
| 2,643,889 | A * | 6/1953 | Ronne | 280/824 |
| 2,721,084 | A * | 10/1955 | Weiss | 280/824 |
| 3,151,875 | A | 10/1964 | Marchand | |
| 3,163,437 | A * | 12/1964 | Phillipson | 280/824 |
| 3,199,886 | A * | 8/1965 | Dover | 280/824 |
| 3,273,575 | A | 9/1966 | Aldrich | |
| 4,316,620 | A * | 2/1982 | Wien | 280/824 |
| 4,669,752 | A * | 6/1987 | Jackson et al. | 280/824 |
| 4,775,168 | A | 10/1988 | Dalebout | |
| 6,015,165 | A * | 1/2000 | Artemis et al. | 280/824 |
| 7,192,058 | B2 * | 3/2007 | Fleming | 280/824 |

FOREIGN PATENT DOCUMENTS

| | | |
|---|---|---|
| AT | 241 319 B | 7/1965 |
| DE | 11 85 098 B | 1/1965 |
| FR | 846 031 A | 9/1939 |

OTHER PUBLICATIONS

International Preliminary Report on Patentability, Jun. 18, 2009.

* cited by examiner

*Primary Examiner* — Frank Vanaman
(74) *Attorney, Agent, or Firm* — Sughrue Mion, PLLC

(57) ABSTRACT

A stick snow ring (1) for a stick is described, with a stick holder (5) for receiving a stick tube. According to the invention, the stick snow ring (1) is characterized in that the snow ring region (2, 3) is designed as an essentially rigid disc and is fastened by means of a joint (4) in a manner such that it can rotate freely about a stick axis (A) and such that it can tilt about a tilt axis (B) over an angular range of 150°. The size of the snow ring can preferably be adapted individually to various use conditions.

26 Claims, 14 Drawing Sheets

Section A-A

Section B-B

SKI-POLE BASKET

TECHNICAL FIELD

The present invention relates to a basket for a pole, in particular for a ski pole, touring ski pole and/or trekking pole, which has a pole casing for accommodating a pole shaft and adapts itself, in particular, to different slope inclinements and can preferably be adapted individually in size to different use conditions.

PRIOR ART

The general task of a pole basket is to ensure, when the pole is used for pushing off from an underlying surface, that the pole is inserted in a controlled manner, and to a limited depth, into the underlying surface/the ground/the layer of snow. The height of the pole basket, which is fixed axially on the pole, determines the insertion depth.

Particular examples of materials which have been used for such baskets up until now are plastics such as PE and PC, but also rubber or vinyl chloride (as described, for example, in DE 2 042 134).

An earlier embodiment had a metal ring which was fastened by means of radial spokes made of flexible material, e.g. leather, on a sleeve/pole casing enclosing the pole, which gave the pole basket flexibility in respect of the nature of the underlying surface and in respect of the arrangement of the plane of the pole basket relative to the pole axis.

The prior art contains various approaches to improving pole baskets. U.S. Pat. No. 4,221,392 describes an asymmetric ski-pole basket which can be adapted to different snow conditions by virtue of different peripheral parts which widen the basket at its rear end being attached to the basic basket and thus by virtue of the basket surface area being changed.

The invention on which U.S. Pat. No. 4,669,752 is based discloses a mechanism which makes it possible for interchangeable baskets of different sizes to be fastened, in addition, in different axial positions along the ski pole.

U.S. Pat. No. 4,385,776 describes a structure on the ski pole which likewise makes it possible for interchangeable baskets of different sizes to be easily fastened in a releasable manner thereon via a snap-fit mechanism.

U.S. Pat. No. 4,336,949 likewise mentions the possibility of fastening interchangeable baskets of different sizes on the ski pole. The core of the invention here is constituted particularly by a defined angle between the ski-pole basket and ski pole, an elastic torsion element and the asymmetry of the basket.

One disadvantage of pole baskets made of inflexible material is that the pole basket cannot adapt itself to the inclination of the underlying surface (e.g. the inclination of slopes in ski touring). However, in the case of pole baskets made of flexible, e.g. thermoplastic, material, which would have this ability to adapt, there is the disadvantage, on the other hand, that at low temperatures, as is mostly the case in ski areas, they become more or less completely stiff when exposed to the cold over a relatively long period of time. Furthermore, it is precisely the specifically flexibly designed regions which become brittle and are usually prone to breaking. On the other hand, the force required for using the pole cannot be transmitted optimally to the underlying surface if a pole basket is formed from such soft material. The pushing-off force is likewise reduced, and contact with the ground via the pole lacks control, if the pole is not placed in position, and inserted, at right angles to the underlying surface.

DESCRIPTION OF THE INVENTION

Accordingly, it is an object of the invention, inter alia, to overcome the disadvantages arising from the prior art and to develop an improved pole basket which can be adapted, in particular, to different slope inclinements and preferably, in addition, also to different snow conditions. These two properties are particularly important in the case of ski touring in particular, but may also be beneficial, for example, for trekking or the like.

This object is achieved, inter alia, by the provision of a basket for a pole having a pole casing for accommodating a pole shaft. The pole basket according to this invention is characterized, inter alia, by the following features: the pole basket has a basket region which is designed as an essentially rigid, i.e. inherently inflexible, stiff disk and which is fastened by a joint such that it can be rotated freely about the longitudinal axis of the pole and can be tilted over an angle range of normally 150 degrees about a tilting axis, which is essentially at right angles to the pole axis. The inherently stiff basket can thus be rotated about two axes: about a first axis, which is arranged essentially along the pole axis, free rotatability being provided about this first axis. Furthermore, the pole basket is mounted such that it can be tilted about a second axis, in order for it to be possible to adapt itself, for example, to the abovementioned slope inclinement. The given angle range for the second axis may also be greater if the pole casing or the joint allow a greater range overall. The core of the invention thus resides, in particular, in forming the basket from stiff material, but in fastening this stiff basket on the ski pole, rather than rigidly, in a flexible manner essentially about two axes by means of a joint or movable connecting element, and thus in achieving the flexibility in respect of the slope inclination by a jointed connection between the basket disk and the ski pole rather than by a flexible material.

It is an essential factor in this context, inter alia, that this ability to move about the two axes is provided by a joint. A joint within the context of the present invention is to be understood as a component or element which makes provision for the ability to move about the two abovementioned axes, the ability to move about the two axes being ensured in each case without any material connection between the elements connected by the joint, i.e. the joint does not have flexible regions which provide for the ability to move (for example in the manner of a film hinge); rather, it has individual elements which slide on one another or roll on one another, essentially without being deformed in the process.

The advantage of this invention resides, inter alia, in that, despite its inherently rigid properties and its resulting robustness, the pole basket, and thus also the pole itself, can be adapted to different slope inclinements. This allows improved transmission of force to the pole for pushing-off purposes. Moreover, this flexibility and the associated movement of the pole basket on the pole give rise, at the same time, to the situation where any snow which possibly ends up located on the pole basket is continuously shaken off. For the purpose of forming the pole basket as an essentially rigid disk, it is possible to use, for example, thermoplastic materials or also combinations of metals, different plastics, fiber-reinforced plastics, fiber composite materials, etc.; examples of possible materials are polyamides, PE, PP, PVC and PC.

A first preferred embodiment is characterized in that the ability of the pole basket to move relative to the pole axis and/or the tilting axis is ensured via inherently rigid elements, by the rigid elements being arranged to roll and and/or slide in one another and/or on one another. In other words, the joint has regions, or elements, respectively, which provide for the ability to move about the two axes, by the elements rolling or sliding on one another.

The pole casing, which is fastened on the pole shaft, preferably engages in a joint opening arranged in the inner basket, such that the inner basket is mounted to be rotatable about the pole casing (connected in a rotationally fixed manner to the pole shaft) relative to the pole axis. In other words, this joint opening, in which the pole casing engages, provides the ability to rotate about the first axis.

According to a further preferred embodiment of the invention, the joint opening is an opening of preferably ellipsoidal, but also possibly oval, polygonal or rectangular form, possibly with rounded corners. This elongate design is advantageous in order to allow the tilting about the second axis. The oval or ellipsoidal form in particular is preferred since, when the inclination is fully utilized, the preferably round or cylindrical outer surface of the pole casing ends up located in optimal fashion on the edge of the opening.

As an alternative, and/or in addition, it is possible and preferred for the joint to have two mutually opposite axially offset joint sleeves on the pole casing and also two mutually opposite, circular joint disks arranged on the inner basket, at least one of the two joint sleeves having an encircling annular groove which is open in the direction of the opposite joint sleeve. The joint disks here may be formed integrally with the inner basket, and, equally, at least one of the joint sleeves may be formed integrally with the pole casing. Essentially half of each of the two mutually opposite joint disks preferably extends on either side of the basket plane defined by the basket region, and essentially at right angles to this plane. The basket plane is defined as essentially parallel to the rigid disk. The two joint disks are located opposite one another in parallel planes, the abovementioned joint opening being arranged between the two joint disks, and preferably such that the two axes of symmetry of the joint disks are arranged in a colinear manner (normally essentially perpendicular to the first axis), and that the axis of symmetry of the first axis or of the joint opening intersects with this axis of symmetry in order for it to be possible to ensure the ability to move as smoothly as possible about the two axes. The rigid inner basket virtually bisects the joint disks in their center, for which reason the partially circular surfaces of the joint disks projecting essentially at right angles from the basket plane are virtually cut out by the thickness of the inner basket in the region of the joint disks, and the joint-disk halves, which extend on both sides of the basket plane, are basically circle segments.

It is particularly advantageous if the diameter of the joint disks is marginally smaller, preferably not more than 0.1-3 mm, preferably 0.2-1.5 mm smaller, than the axial spacing between the two joint sleeves on the pole casing. The axial spacing of the joint sleeves shall be defined as the spacing between the base (or the essentially lowermost region) of the open annular groove and that surface of the opposite sleeve which is directed toward this annular-groove base. If both sleeves have annular grooves, or if both have a base, then the axial spacing between the joint sleeves is to be understood as the spacing between the two axially opposite annular-groove bases.

A preferred embodiment is characterized in that at least those halves of the two joint disks which are directed toward an open annular groove engage in the annular groove, and in that in particular when at least those halves of the two joint disks which, starting from the basket plane, are directed toward the annular groove have a width which is insignificantly smaller, preferably no more than 0.1-3 mm, preferably 0.2-1.5 mm smaller, than the breadth or the width present in that area of the annular groove.

The annular groove may be in different forms, for example it may be an angular or round U-shaped groove or else also a V-shaped groove and, correspondingly, the encircling edge of the joint disks is preferably then also provided with corresponding shaping, in order for the friction during sliding action to be kept as low as possible. The annular groove is preferably bounded, on at least one side, by a ridge, which is of round or angular design, and the difference between the width of the joint disks is smaller than the width of the annular groove only to the extent where it is just possible for the joint disk to engage in the annular groove between the ridge and the lateral surface of the pole casing.

A further preferred embodiment of the pole basket has an inner basket which is made of rigid material and to which outer-basket rings of different external diameters can be attached, and preferably fastened in a releasable manner. These outer-basket rings are preferably designed to be just as rigid as the inner basket, preferably being made of the same material. It is conceivable here for the inner basket to be made in a different color from the outer-basket rings, and it is also possible for the outer-basket rings for different sizes to be made in different colors and/or patterns. The interchangeability of the outer-basket ring would also be conceivable, in principle, without being combined with the joint outlined above. The outer-basket ring can be fastened to the inner basket by means of different possible preferably straightforward and robust latching-in mechanisms, and it can be released from the inner basket again by preferably just as straightforward and robust an unlatching mechanism.

In particular it is possible to provide a design where the outer-basket ring can be attached to the inner basket in the axial direction along the pole axis, and where the outer-basket ring can be fastened on the inner basket by a rotary movement in the basket plane about the pole axis. This rotary movement can be in an angle range of preferably approximately 3-30 degrees, depending, for example, on the length and/or width and on the number of corresponding tongues or other guiding and/or latching-in means. Such a plug-in rotary fastening mechanism, also referred to as a bayonet closure, is known from other sectors of technology and may additionally have, for example, a catch, in order that the closure can only be opened again following the release of this catch.

As an alternative, or in addition, it is, in other words, possible for the outer-basket ring to be configured such that it can be fastened with self-latching action on the inner basket.

In addition, it is advantageous if the outer-basket ring has in the peripheral region, on its underside, a toothing formation. This toothing formation allows better adherence of the basket to the underlying surface.

In a further embodiment, the outer-basket ring, for locking purposes, has at least one engagement element, preferably a pin, which engages in a cutout in the inner basket, in particular on the periphery of the latter, or vice versa, since it is also conceivable for engagement elements on the inner basket to engage in cutouts in the outer-basket ring. The engagement element preferably projects at right angles to the basket plane defined by the basket region. As an alternative, it is also possible for the engagement element and, accordingly, the corresponding cutouts to be oriented in a radial direction.

It proves to be advantageous in this embodiment if the pin has a head of which the diameter is larger than the diameter of the pin body, in particular if the peripheral cutouts on the inner basket or outer basket, respectively, have a hole with a diameter which is insignificantly larger than the diameter of the pin head, and if this hole merges, in the circumferential direction of the basket region, into a slot of which the width is smaller than the diameter of the pin head, but is marginally larger than the diameter of the pin body.

It may be advantageous for a further preferred embodiment if the inner basket and/or the outer-basket ring have/has radial spokes essentially in the basket plane, so that, if both the inner basket and the outer-basket ring have radial spokes, the radial spokes in the outer basket ring virtually constitute an extension of the spokes of the inner basket, in particular if at least one spoke has at least one guide and a locking device which, following attachment of the outer-basket ring, can be displaced along the guide in order to lock the outer-basket ring. Following attachment, the outer-basket ring can be fixed on the inner-basket ring for example by virtue of the locking element being latched in or by virtue of being rotated, in which case the outer-basket ring cannot be rotated any longer relative to the inner basket.

It proves to be advantageous, furthermore, if the inner basket, along its periphery, has a groove, from which is formed at least one side of inner-basket tongues, and if outer-basket-ring tongues are pushed into the groove and can be latched in by a rotary movement. A functionally identical mechanism is also provided, of course, when the outer basket has such a groove along its periphery, into which inner-basket tongues can be pushed and latched in by a rotary movement.

The tilting axis is preferably essentially at right angles to the pole axis. The basket region is typically fastened such that it can be tilted over an angle range of approximately 100-150 degrees about the tilting axis. Purely theoretically, the maximum tilting angle could be up to 180 degrees, but the technical configuration, the shape and the material of the joint elements, in particular of the joint sleeves and of the annular grooves, limit this angle. The pole basket effectively adapts itself to a slope inclination of up to typically not more than approximately 40-60 degrees. The angle range over which the pole basket can tilt about the tilting axis is thus approximately 100 degrees. In the maximum tilting position, the joint sleeves are normally in contact with both the joint disks and the basket plane.

In a particularly preferred embodiment, the abovementioned pole basket is a ski-pole basket, in particular a basket for touring skis.

Further possible embodiments within the meaning of the present invention are as follows:

A rotary/tilting mechanism may also be achieved by a device which essentially comprises a ball which encompasses the pole shaft, can be rotated freely about the pole axis, or else as an alternative is also fixed thereto, but cannot be moved axially and is "clamped in" by a casing sleeve fastened on the pole basket in that the casing sleeve, on the surface engaging around the ball, has essentially the same radius as the ball itself. It is thus possible for the pole basket to be both rotated freely about the pole axis and tilted freely relative to the tilting axis over an angle range of approximately 150 degrees, in effect approximately 100 degrees. When the pole is inserted, this allows a virtually conical rotary movement of the pole through 360 degrees.

Furthermore, other latching-in mechanisms for the outer-basket ring are also possible. For example, the ability to rotate may be provided in that a pole casing which can be rotated freely about the pole shaft, but is fixed axially, has at least two flanges/engagement elements to which an inner basket with corresponding cutouts can be attached for tilting action. In the same way, it is possible to provide a pole casing which can be rotated freely about the pole shaft, but is fixed axially, to which the basket is attached for movement via two opposite and colinear axes.

BRIEF EXPLANATION OF THE FIGURES

The invention shall be explained in more detail hereinbelow by way of exemplary embodiments, in conjunction with the drawings. The figures should be used here in order to support and illustrate the possible ways of implementing the invention, but not for limiting the general idea of the invention as defined in the introduction and in the accompanying patent claims. In the figures:

WAYS OF IMPLEMENTING THE INVENTION

Figure 1A:
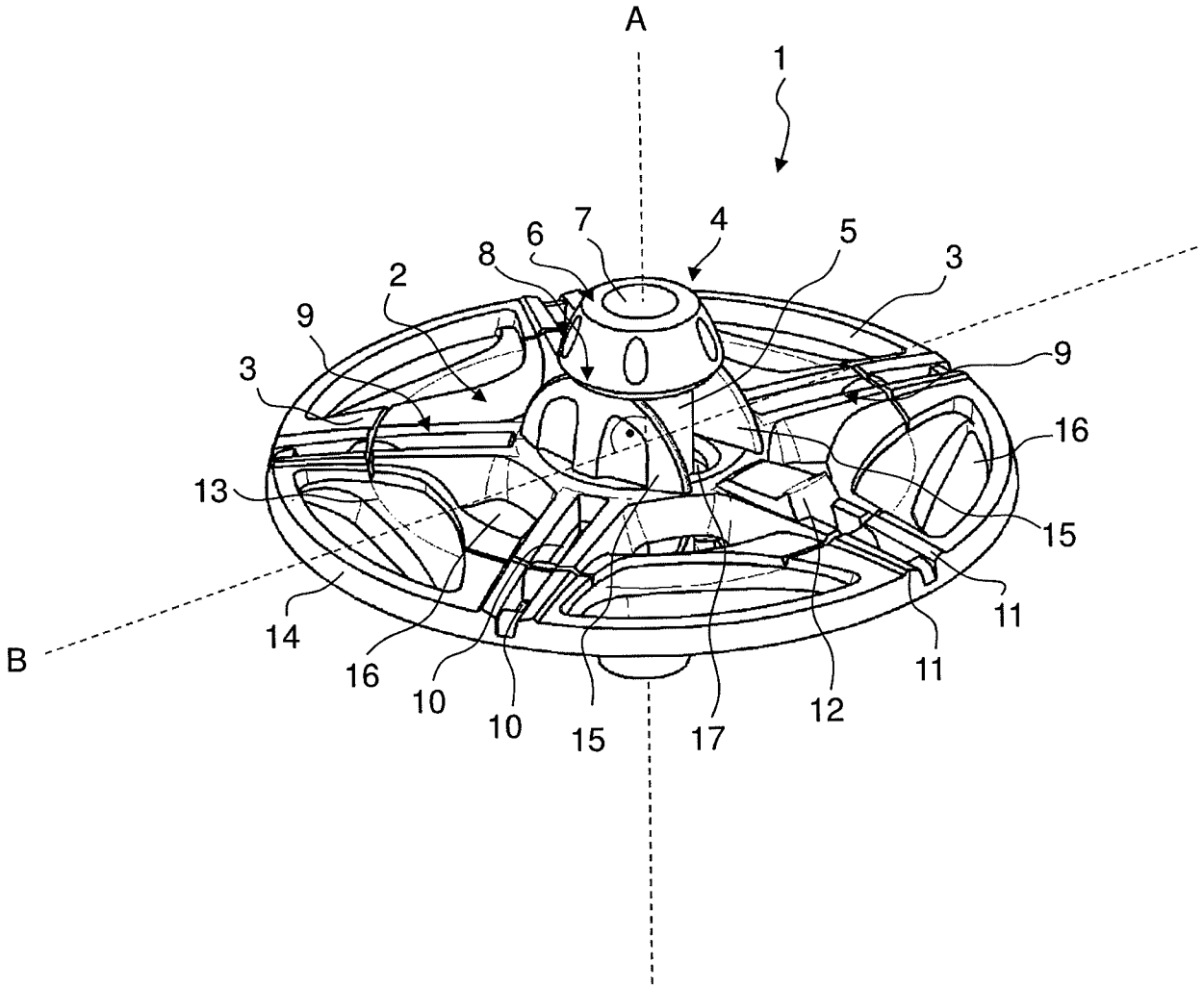
FIG. 1 shows views of the pole basket with the outer-basket ring attached, in which a) illustrates a perspective view; b) illustrates a view of the pole basket from beneath; c) illustrates a side view of the pole basket, with inner basket and outer-basket ring attached, parallel to the basket plane with the locking element directed in the viewing direction; d) illustrates a view of FIG. 1*c* rotated by 90 degrees; e) illustrates a view of FIG. 1*c* rotated by 180 degrees; f) illustrates a view of FIG. 1*c* rotated by 270 degrees; g) illustrates a view of the pole basket from above; h) illustrates a section through plane A-A of FIG. 1*c;* and i) illustrates a section through plane B-B of FIG. 1*d;*
Figure 1B:
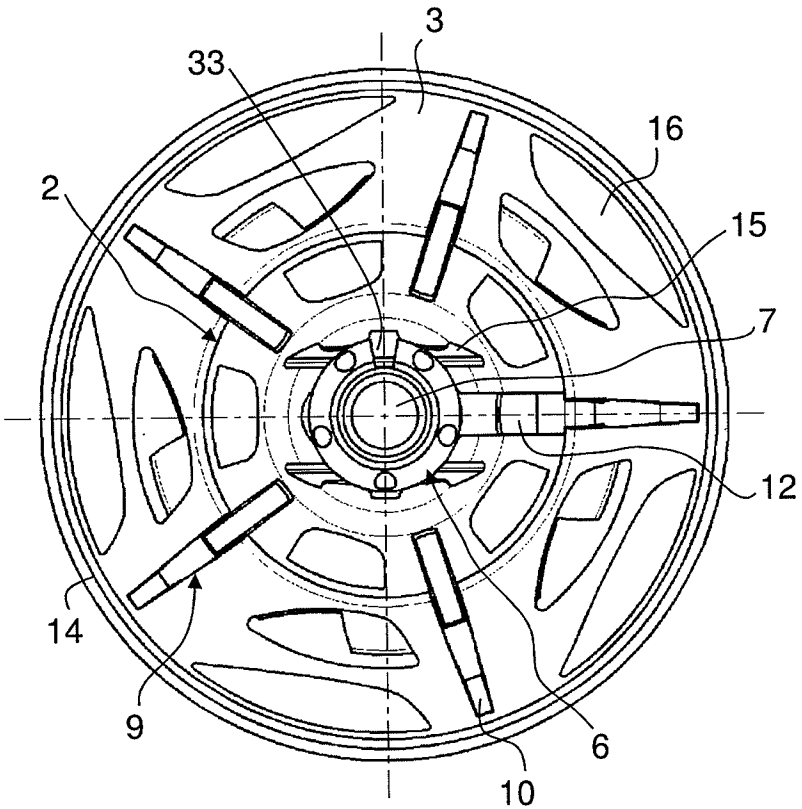
Figure 1C:
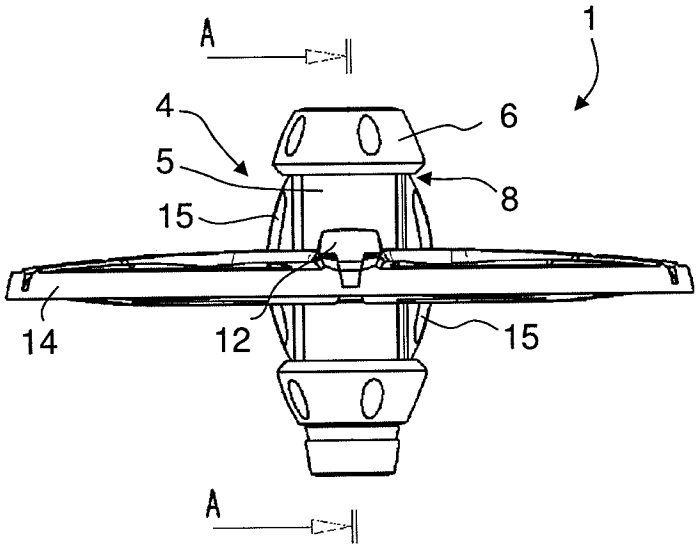
Figure 1D:
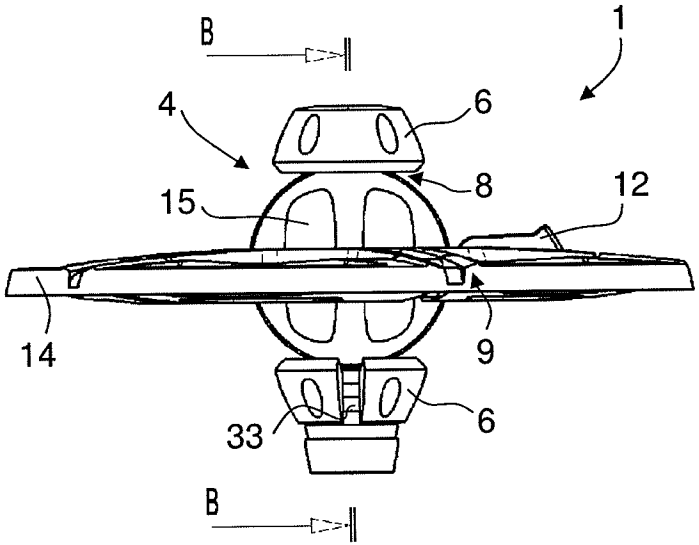
Figure 1E:
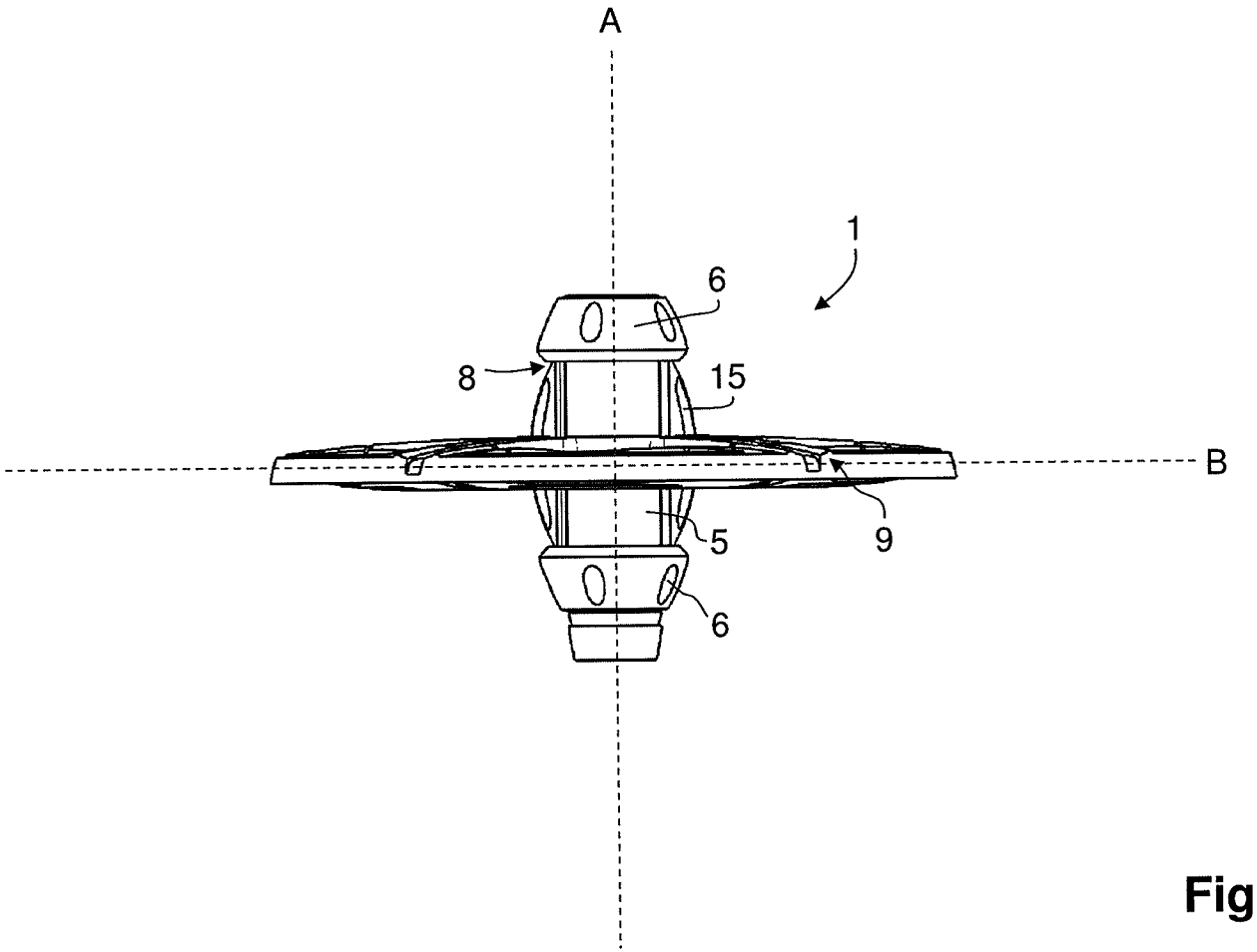
Figure 1F:
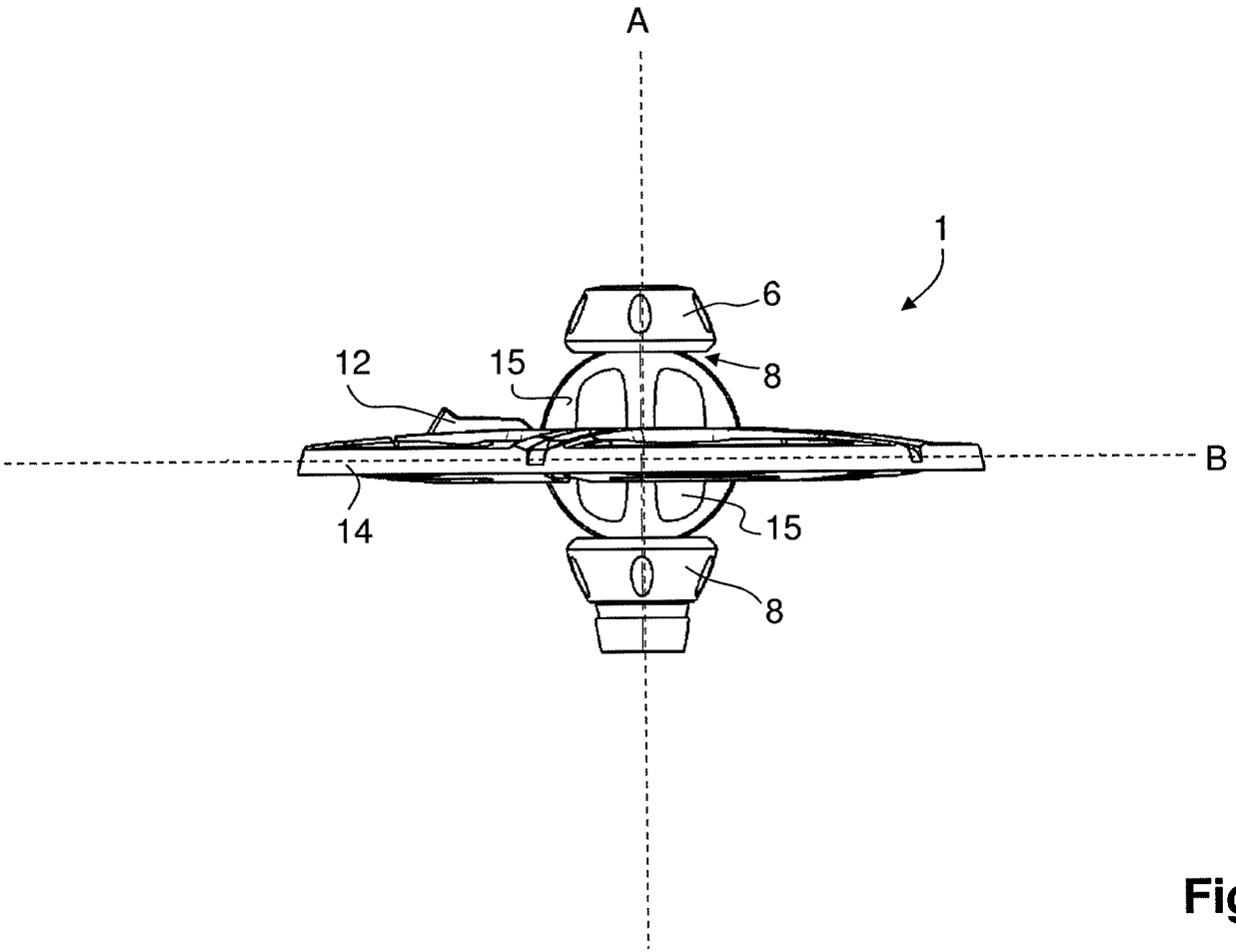
Figure 1G:
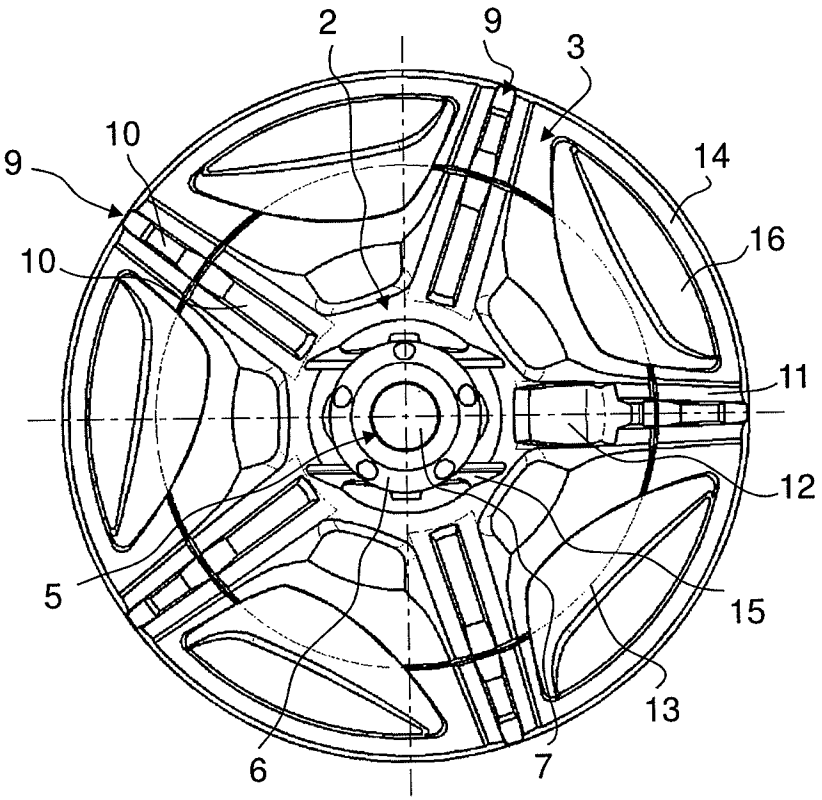

FIGS. 1*a*-1*i* and FIGS. 2 and 3 illustrate a first exemplary embodiment of a pole basket. This exemplary embodiment contains a pole basket 1 which has an essentially circular inner basket 2 and an essentially annular outer-basket ring 3 attached thereto, the internal diameter of the outer-basket ring 3, which provides the form fit, being essentially equal to the outer radius of the inner basket 2. Both the inner basket 2 and the outer-basket ring 3 could also be of non-circular form, for example star-shaped or even asymmetrical, the inner periphery of the outer-basket ring 3 ideally being adapted to the shape of the outer periphery of the inner basket 2.

The pole basket 1 comprises a joint region 4 and a basket region 2, 3. The basket region has an inner basket 2 with a joint opening 17 flanked by circular joint disks 15. A pole casing 5 with joint sleeves 6 for accommodating a pole shaft (not illustrated in the figures) through the opening 7 is introduced through this joint opening 17. Radial spokes 9 are arranged preferably essentially in a star-shaped manner in the basket plane defined by the basket region 2, 3, but they may also deviate from this arrangement. The spokes 9 can extend radially up to the periphery 14 of the outer-basket ring 3 as is illustrated, for example, in FIGS. 1*a, c, d-g* and FIG. 3.

The ability of the pole basket to move/tilt relative to the pole casing 5, which is fastened on the pole shaft, is limited essentially by the joint disks 15 and by the shape and diameter of the joint opening 17. As can be seen particularly well in FIGS. 1*c-f*, the two joint disks 15, which are coaxial and located opposite one another in parallel planes, are formed essentially at right angles to the basket plane defined by the basket region 2, 3, and being essentially parallel to the basket region 2, 3, and half of each of the joint disks extends on each side of the basket plane, as can be seen in FIGS. 1*c-f* and 1*h* and 1*i*.

When the pole basket 1 is tilted, the joint disks 15 slide, by way of their circle arc/circumference, along the joint sleeves 6 on the pole casing 5, wherein at least those two circle segments of the joint disks 15 which extend on that side of the basket plane on which is fastened the joint sleeve 6 with the open annular groove 8 directed toward the opposite joint sleeve 6 engages in the annular groove 8. The joint disks 15 here are always positioned in the annular groove 8 of the joint sleeve 6. The joint disks 15 are preferably designed as radially outwardly concave ball sectors, which contributes to increased stability of the joint disks 15, and thus of the joint 4.

The inner surfaces of the joint disks 15 loosely abut the joint casing 5, at a small distance therefrom, and the inner basket 2 can thus be rotated freely about the pole axis A and about the pole casing 5. It is thus possible for the pole basket 1 on the pole casing 5 to be simultaneously rotated freely about the pole axis A and tilted about a tilting axis B, which is essentially at right angles to the pole axis A.

Cutouts 16 for weight-reduction purposes are possible, as is the case for example in FIG. 1*a*, both on the inner basket 2 and on the outer-basket ring 3. Even the joint sleeve 6 may have material cutouts for weight-reduction purposes (illustrated in FIGS. 1*a-g* and FIG. 2), and likewise also the joint disks 15 (visible in FIGS. 1*a, c-f* and FIG. 2).

Figure 1H:
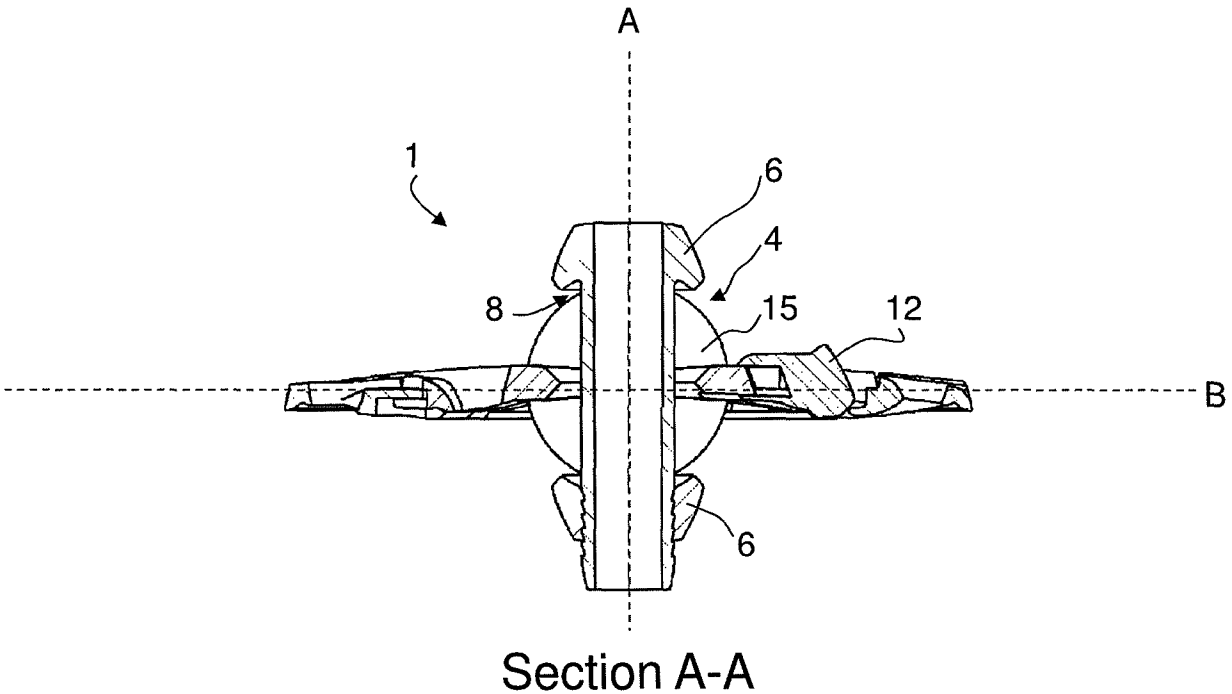
Figure 1I:
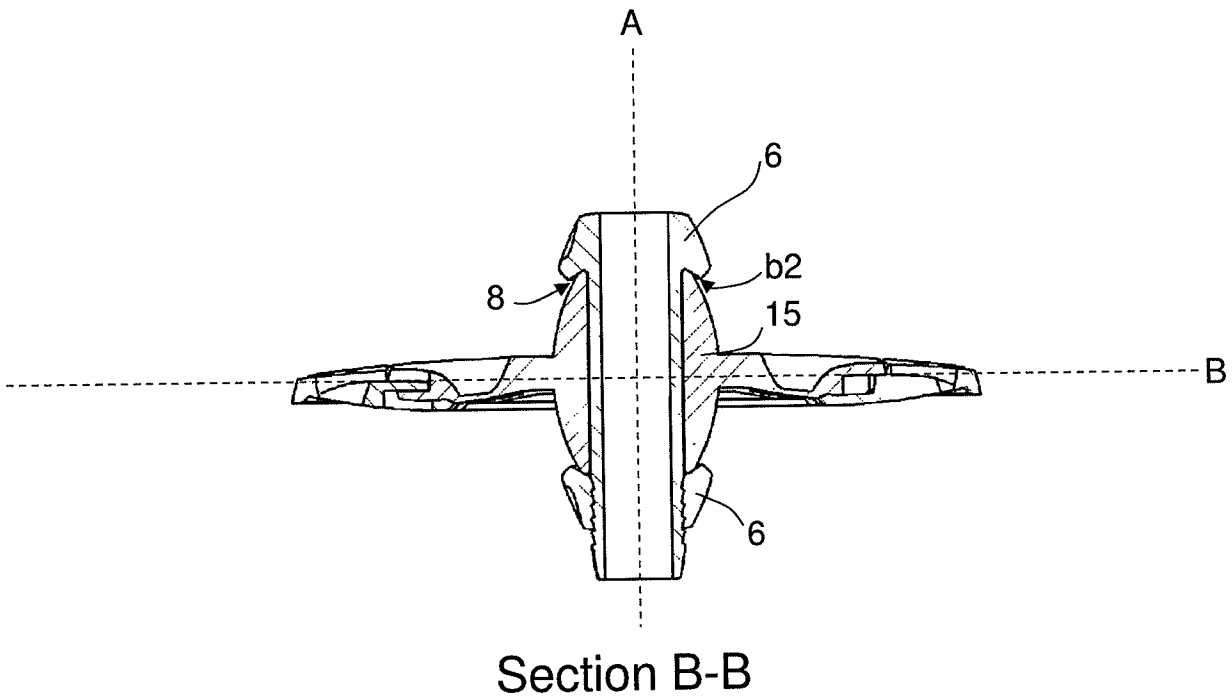
Figure 2:
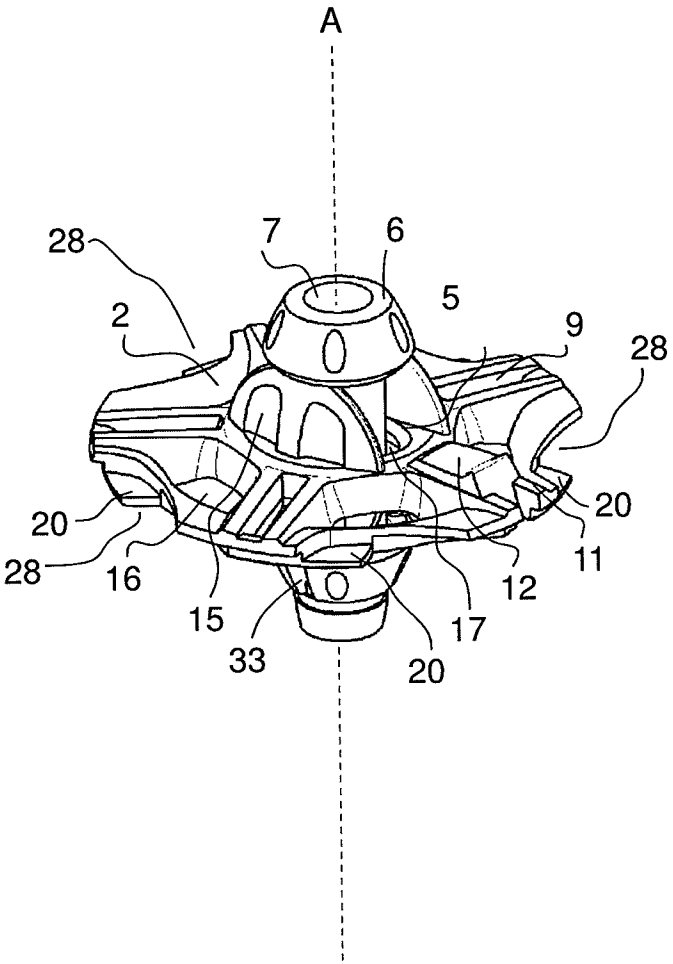
FIG. 2 shows a perspective view of the inner basket without an outer-basket ring attached.

It can be seen from FIG. 1*h* that the pole casing 5 is formed integrally with a fixed (top) joint sleeve 6, while the inner basket 2, possibly with the outer-basket ring 3 attached, but always with the joint disks 15 fastened on the inner basket 2, constitutes a separate part, which is attached in an axial direction to the free, bottom end of the pole casing 5 (without joint sleeve) during production or assembly, respectively. For assembly purposes, the second joint sleeve 6 is then likewise attached to the free end, the pole casing 5 having at the free end a structure which allows the joint sleeve 6 to be attached to the pole casing 5 by screw connection or latching in (toothing formation, thread). According to FIG. 1*d*, the joint sleeve 6 which is attached as the second joint sleeve during assembly has a slot 33 which allows clamping action of the joint sleeve 6 and facilitates assembly.

It can additionally be seen from the cross section in FIG. 1*h* that the underside of the pole basket 1 has provided on it a structure into which the locking element 12 can be latched radially in the direction of the periphery 14.

Figure 3:
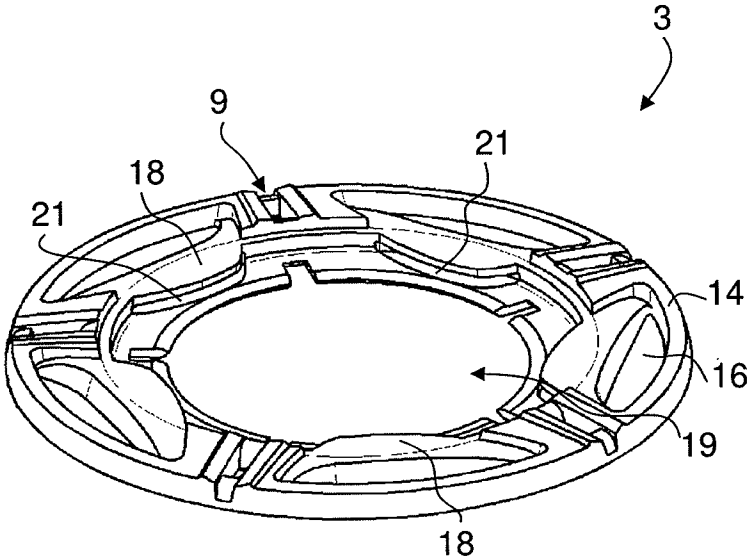
FIG. 3 shows a perspective view of the outer-basket ring on its own.

The first preferred exemplary embodiment of the invention according to FIGS. 1*a*-1*i* and FIGS. 2 and 3 has an inner basket 2 which is made of rigid material and has radial spokes 9 in the basket plane defined by the basket region 2, 3. The annular outer-basket ring 3 likewise has spokes 9 which, in the attached state, constitute an extension of the spokes 9 of the inner basket 2. The guide 11 of the inner basket 2 is thus likewise extended in the radially outward direction by virtue of the outer-basket ring 3 being attached. At least one of the spokes 9 has a locking device 12 which, following attachment of the outer-basket ring 3, is displaced along the guide 11 in order for the outer-basket ring to be fixed. This locking device 12 is illustrated, in FIG. 1*c*, in cross section as seen from the periphery of the outer-basket ring 3 and, in FIG. 1*h*, from the side. In order for the outer-basket ring 3 to be attached, it is positioned concentrically on the inner basket 2 from the axial direction and rotated until the outer-basket-ring tongues 18 (illustrated in FIG. 3) end up located above or beneath the inner-basket tongues 20, respectively (illustrated in FIG. 2). The rotary position of the outer-basket ring 3 is then fixed by the locking device 12 being actuated radially in the direction of the periphery 14 of the ring. The outer-basket ring 3 is thus prevented from rotating relative to the inner basket 2. In order for the outer-basket ring 3 to be removed again, the locking device 12 is actuated radially inward in the direction of the joint 4 and the outer-basket ring 3 is then rotated on the inner basket 2 about the pole axis A in the counterclockwise direction, if the latching-in operation took place in the clockwise direction, or vice versa, such that the outer-basket-ring tongues 18 and the inner-basket tongues 20 are no longer in engagement. The outer-basket ring 3 which is illustrated in FIG. 3 has a planar peripheral region on its underside. However, it is possible for the outer-basket ring 3 to have a toothed peripheral region on its underside, the teeth being oriented downward in order to allow better adherence to the underlying surface.

Figure 4A:
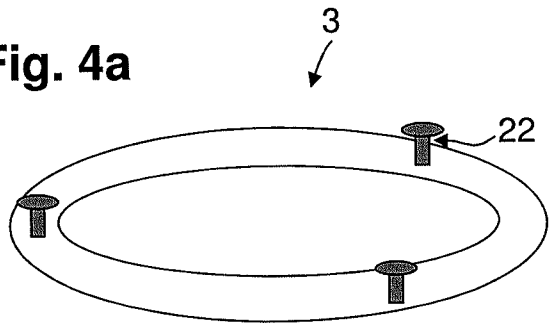
FIG. 4 shows a further exemplary embodiment of a pole basket, in which a) illustrates a perspective view of an outer-basket ring with engagement elements, in this case in the form of pins; b) is a schematic illustration of the pin of FIG. 4*a* in a perspective view; c) is a schematic illustration of the inner basket with cutouts; and d) is a schematic illustration of the cutout of FIG. 4*c;*
Figure 4B:
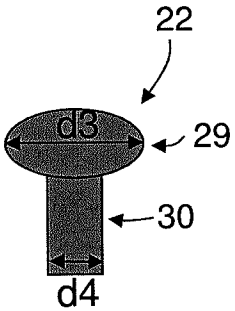

FIG. 4*a* shows, according to a second exemplary embodiment of the invention, an outer-basket ring 3 which has engagement elements of a form which is illustrated schematically in FIG. 4*b*. According to this exemplary embodiment, the engagement elements are designed as pins 22. A pin 22, for this exemplary embodiment, may be defined such that it has a pin head 29 and a pin body 30. However, in a further exemplary embodiment, the engagement elements could also be of some other (functionally identical) form.

Figure 4C:
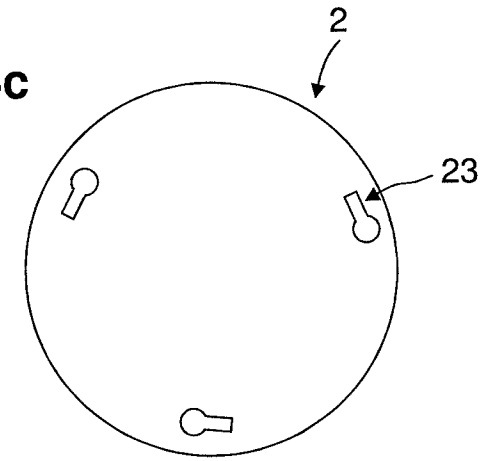

FIG. 4*c* shows, according to the same exemplary embodiment of the invention as in FIGS. 4*a* and 4*b*, an inner basket 2 which is made of rigid material and, along its periphery, has cutouts 23 through which the pins 22 of the outer-basket ring 3 can engage and can be latched in by a small rotary movement over an angle range of approximately 3 to 30 degrees about the pole axis.

Figure 4D:
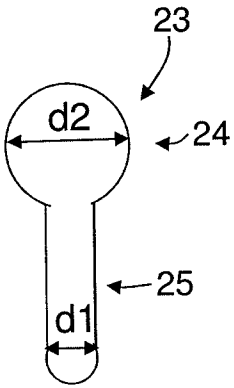

FIG. 4*d*, once again, illustrates a cutout 23 of FIG. 4*c*, this time on its own. In this embodiment, the cutout has a hole 24 with a diameter d2 which is somewhat larger than the diameter d3 of the engagement element, which is illustrated schematically in FIG. 4*b* and, according to this embodiment, is a pin 22 (according to this exemplary embodiment having a pin head 29 and a pin body 30), on the outer-basket ring 3, but larger only to the extent that a pin head 29 just fits through the hole 24. This hole 24 merges into a slot 25 of which the width b3 is marginally smaller than the diameter d3 of the pin head 29 on the outer-basket ring 3. If a plurality of slots 25 are arranged circumferentially along the periphery of the inner basket 2, then it is necessary for all the slots 25 to be oriented in the same way in the circumferential direction. As an alternative, the slot 25 may also be formed by a rectangle which merges into a hole 24. The slots here may also have a curved profile which follows the course around the pole axis.

Figure 5D:
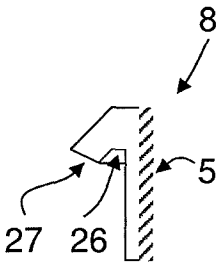
FIG. 5 shows, in *a)-f)*, schematic illustrations of possible embodiments of annular grooves as seen in radial sections through the pole axis.
Figure 5C:
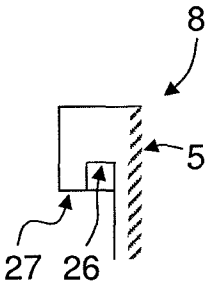
Figure 5B:
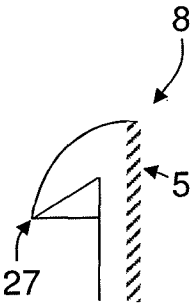
Figure 5F:
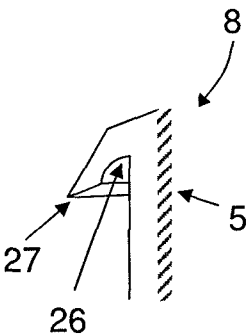
Figure 5A:
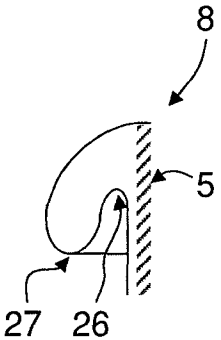
Figure 5E:
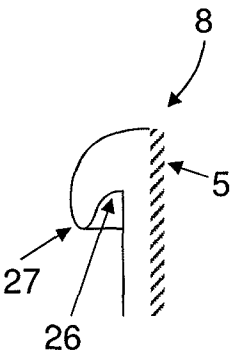

FIGS. 5*a-f* show different possible exemplary embodiments of an annular groove 8 on a joint sleeve 6. The annular groove 8 is preferably bounded, on at least one side, by a ridge 27, which may be of round or angular design. The joint disks 15, which engage in the open annular groove 8, are preferably designed essentially to correspond to the annular groove 8, ideally with adaptation to the shape of the annular groove 8, so that they can therefore engage in the annular groove 8 in an as far as possible friction-free manner, but nevertheless with good guidance. That is to say, if the annular groove 8 is of V-shaped design, as an exemplary embodiment in FIG. 5*b* shows, then the joint disk 15 is likewise V-shaped along its periphery, albeit in a manner which complements the annular groove 8. If the annular groove 8 has an angular base 26 projecting essentially at right angles to the pole axis A, then the joint disk 15 is ideally also of angular or possibly rounded design. The annular groove 8 may also be bounded, on at least one side, preferably on the radially outer side, by a ridge 27, it not being necessary for the connection between the base 26 and the ridge 27 to be right-angled. The corners of the annular-groove base 26 may also be rounded, as is also illustrated schematically in FIG. 5.

Figure 6:
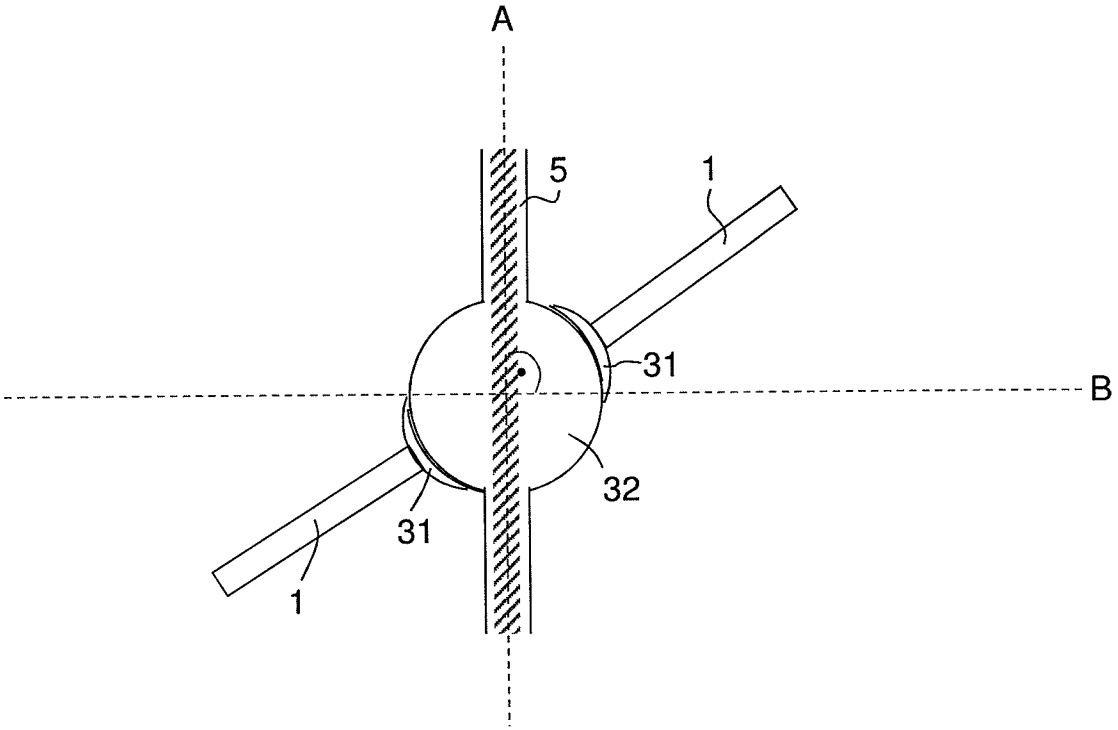
FIG. 6 shows a schematic illustration of a further exemplary embodiment; the pole basket here is located in a position in which it has been tilted relative to the tilting axis.

FIG. 6 illustrates a further exemplary embodiment, which has a ball which encompasses the pole shaft and onto which a pole basket is clamped by means of a sleeve casing. The ball is mounted such that it can be rotated freely about the pole axis, or else as an alternative also fixed thereto, but cannot be moved in the axial direction. The sleeve casing, which is fastened on the pole basket, can "clamp in" the ball in that the sleeve, on the surface engaging around the ball, has essentially the same radius as the ball itself. It is thus possible for the pole basket to be both rotated freely about the pole axis and tilted freely relative to the tilting axis over an angle range of approximately 150 degrees, in effect approximately 100 degrees. When the pole is inserted, this allows a virtually conical rotary movement of the pole through 360 degrees.

LIST OF DESIGNATIONS

1 Pole basket
2 Inner basket
3 Outer-basket ring (attachments)
4 Joint
5 Pole casing
6 Joint sleeve
7 Opening in 5 for pole shaft
8 Annular groove for accommodating 15
9 Radial spokes
10 Cutout in spokes
11 Guide
12 Locking device
13 Separating line between 2 and 3
14 Periphery of ring
15 Joint disk
16 Cutout
17 Joint opening
18 Outer-basket-ring tongue
19 Cutout in 3 in the form of 2
20 Inner-basket tongue
21 Arcuate slot
22 Pin
23 Cutout in 2
24 Hole in 2
25 Slot in 2
26 Base of 8
27 Ridge of 8
28 Groove in 2
29 Pin head
30 Pin body
31 sleeve casing
32 Ball
33 Slot
A Pole axis and axis of rotation
B Tilting axis
d1 Width of 25
d2 Diameter of 24
d3 Diameter of 29
d4 Diameter of 30
d5 External diameter of 3
b1 Width of 8
b2 Width of 15

The invention claimed is:

1. A basket for a pole, having a pole casing for accommodating a pole shaft, comprising:

a basket region designed as a rigid disk and fastened by a joint such that the basket region can be rotated freely about a pole axis and can be tilted over an angle range of 150 degrees about a tilting axis, wherein the pole casing, which is fastened on the pole shaft, engages in a joint opening provided in an inner basket, and the inner basket is therefore mounted such that it can be rotated freely about the pole casing relative to the pole axis, and wherein the joint, on the pole casing, has two mutually opposite axially offset joint sleeves and also two mutually opposite, circular joint disks fastened on the inner basket, wherein at least one of the two joint sleeves has an open annular groove which is open in the direction of an opposite joint sleeve, and wherein essentially half of each of the two mutually opposite joint disks extends on either side of a basket plane defined by the basket region, essentially at right angles to said basket plane.

2. A basket for a pole, having a pole casing for accommodating a pole shaft, comprising:

a basket region designed as a rigid disk and fastened by a joint such that the basket region can be rotated freely about a pole axis and can be tilted over an angle range of 150 degrees about a tilting axis, wherein the pole basket has an inner basket which is made of rigid material and to which outer-basket rings of different external diameters can be attached, wherein the inner basket, along its periphery, has at least one groove, from which is formed at least one side of inner-basket tongues, and wherein outer-basket-ring tongues are pushed into the at least one groove and can be latched in by a rotary movement, or vice versa.

3. A basket for a pole, having a pole casing for accommodating a pole shaft, comprising:

a basket region designed as a rigid disk and fastened by a joint such that the basket region can be rotated freely about a pole axis and can be tilted over an angle range of 150 degrees about a tilting axis, wherein the pole basket has an inner basket which is made of rigid material and to which outer-basket rings of different external diameters can be attached, and wherein the inner basket and the outer-basket ring have radial spokes essentially in the basket plane, such that the radial spokes in the outer-basket ring constitute an extension of the radial spokes of the inner basket.

4. The pole basket as claimed in claim 1, 2 or 3, wherein the ability of the pole basket to move relative to the pole axis or the tilting axis is ensured via rigid elements, the rigid elements being arranged to slide or roll in one another or on one another.

5. The pole basket as claimed in claim 2 or 3, wherein the pole casing, which is fastened on the pole shaft, engages in a joint opening provided in the inner basket, and the inner basket is therefore mounted such that it can be rotated freely about the pole casing relative to the pole axis.

6. The pole basket as claimed in claim 1, wherein the joint opening is one of ellipsoidal, oval, polygonal or rectangular design.

7. The pole basket as claimed in claim 2 or 3, wherein the joint, on the pole casing, has two mutually opposite axially offset joint sleeves and also two mutually opposite, circular joint disks fastened on the inner basket, wherein at least one of the two joint sleeves has an open annular groove which is open in the direction of the opposite joint sleeve, and wherein essentially half of each of the two mutually opposite joint disks extends on either side of the basket plane defined by the basket region, essentially at right angles to this plane.

8. The pole basket as claimed in claim 1, wherein the diameter of the joint disks is smaller than the axial spacing between the two joint sleeves on the pole casing, wherein at least those halves of the two joint disks which are directed towards the open annular groove engage in the annular groove.

9. The pole basket as claimed in claim 8, wherein at least those halves of the two joint disks which, starting from the basket plane, are directed toward the annular groove have a width which is smaller than the width of the annular groove.

10. The pole basket as claimed in claim 1, wherein on at least one side, the annular groove is bounded by a ridge, which is of round or angular design.

11. The pole basket as claimed in claim 1, wherein the pole basket has an inner basket which is made of rigid material and to which outer-basket rings of different external diameters can be attached.

12. The pole basket as claimed in claim 11 or 3, wherein the outer-basket ring can be fastened in a releasable manner on the inner basket.

13. The pole basket as claimed in claim 11 or 3, wherein the outer-basket ring can be attached to the inner basket in the axial direction along the pole axis, and wherein the outer-basket ring can be latched in or fastened on the inner basket by a rotary movement in the basket plane.

14. The pole basket as claimed in claim 11, 2 or 3, wherein the outer-basket ring can be fastened with self-latching action on the inner basket.

15. The pole basket as claimed in claim 11 or 3, wherein the outer-basket ring, for locking purposes, has at least one engagement element which engages in a cutout in the inner basket, or vice versa.

16. The pole basket as claimed in claim 11 or 2, wherein the inner basket or the outer-basket ring has radial spokes essentially in the basket plane.

17. The pole basket as claimed in claim 11 or 3, wherein the inner basket, along its periphery, has at least one groove, from which is formed at least one side of inner-basket tongues, and wherein outer-basket-ring tongues are pushed into the groove and can be latched in by a rotary movement, or vice versa.

18. The pole basket as claimed in claim 11 or 3, wherein the outer-basket ring has at least one pin which projects radially or at right angles to the basket plane defined by the basket region, and wherein the inner basket has a peripheral cutout in which the pin can engage.

19. The pole basket as claimed in claim 18, wherein the pin has a head of which the diameter is larger than the diameter of the pin body.

20. The pole basket as claimed in claim 19, wherein the peripheral cutout on the inner basket has a hole with a diameter which is larger than the diameter of the pin head, the hole merging, in a circumferential direction of the inner basket, into a slot of which the width is smaller than the diameter of the pin head, but is larger than the diameter of the pin body.

21. The pole basket as claimed in claim 1, 2 or 3, wherein the tilting axis is arranged essentially at right angles to the pole axis.

22. The pole basket as claimed in claim 1, 2 or 3, wherein the basket region is fastened such that it can be tilted over an angle range of 100 - 120 degrees about the tilting axis.

23. The pole basket as claimed in claim 1, 2 or 3, wherein the pole basket is a ski-pole basket.

24. The pole basket as claimed in claim 1, wherein the annular groove is bounded on the radially outer side by a ridge of round or angular design.

25. The pole basket as claimed in claim 11 or 2, wherein the inner basket and the outer-basket ring have radial spokes essentially in the basket plane, it being the case that the radial spokes in the outer-basket ring constitute an extension of the spokes of the inner basket.

26. The pole basket as claimed in claim 25, wherein at least one spoke has at least one guide and a locking device which, following attachment of the outer-basket ring, can be displaced along the guide in order to lock the outer-basket ring.

* * * * *